United States Patent [19]

Breslow

[11] 3,994,492

[45] Nov. 30, 1976

[54] GAME APPARATUS

[75] Inventor: Jeffrey D. Breslow, Highland Park, Ill.

[73] Assignee: Marvin Glass & Associates, Chicago, Ill.

[22] Filed: Oct. 20, 1975

[21] Appl. No.: 623,757

[52] U.S. Cl. ..... 273/1 R

[51] Int. Cl.[2] ..... A63F 9/00

[58] Field of Search ..... 273/1 R, 95 R, 102.1 R, 273/102.1 C; 272/27 R, 27 B

[56] References Cited

UNITED STATES PATENTS

| | | | |
|---|---|---|---|
| 3,120,958 | 2/1964 | Glass | 273/102.1 R |
| 3,402,929 | 9/1968 | Glass | 273/1 R |
| 3,582,070 | 6/1971 | Breslow | 273/1 R |
| 3,583,705 | 6/1971 | Hill | 273/1 R |
| 3,630,520 | 12/1971 | Cooper | 273/1 R |
| 3,807,731 | 4/1974 | Lemelson | 273/1 R |

*Primary Examiner*—William H. Grieb
*Attorney, Agent, or Firm*—Coffee and Sweeney

[57] ABSTRACT

A game apparatus is provided which includes a generally hollow housing formed in the shape of a miniature shark having a pivotally mounted lower jaw portion. The pivotal lower jaw is mounted upon a horizontal axis and biased toward a closed position by a pair of resilient rubberbands. A plurality of game objects of different shapes and weights are provided to be placed on the lower jaw portion so that the cumulative weight of all of the game objects maintains the lower jaw in an open position. A set of cards determine which one of the playing pieces a player of the game is to retrieve from the lower jaw, and an elongated implement having a hook portion is provided to retrieve the game objects from the lower jaw portion. As the game objects are removed and the weight on the jaw lessened, at one point the lower jaw portion will snap shut under the force of the resilient rubberbands to terminate a round of play.

11 Claims, 4 Drawing Figures

LANTERN
30 POINTS
SKULL
10 POINTS
50
48

10
14
16
17
18
22
24
26
28
30
32
34
38
40
42
44
46
50
72
73
2
3

GAME APPARATUS

BACKGROUND OF THE INVENTION

1. Field of the Invention

The present invention relates to game devices and in particular to those requiring speed and agility on the part of the players.

2. Description of the Prior Art

In the past, game devices which involve a degree of participation by the users of the game have been well received by the public. Particularly, games which simulate certain sporting events and yet make it practical for them to be played indoors, have been quite popular. Previous attempts to provide a game utilizing a partially animated figure have lacked certain real life characteristics which are desirable in a game of this type.

SUMMARY OF THE INVENTION

An object of the present invention is to provide a new and useful game apparatus utilizing a figure of a miniature shark or other fish or mammal.

The exemplary embodiment of the game apparatus of the present invention includes a generally hollow housing formed in the shape of a miniature shark having a pivotally mounted lower jaw portion. The pivotal lower jaw is mounted upon a horizontal axis and biased toward a closed position by a pair of resilient rubberbands. A plurality of game objects of different shapes and weights, such as simulated treasures, are provided to be placed on the lower jaw portion so that the cumulative weight of all of the game objects maintains the lower jaw in an open position. A set of cards determine which one of the playing pieces a player of the game is to retrieve from the jaw, during his turn, and an elongated implement having a hook portion is provided to retrieve the game objects from the lower jaw portion. As the game objects are removed and the weight on the jaw portion lessened, at one point the jaw portion will snap shut under the force of the resilient rubberbands. The cards dictate how many points are awarded to a particular player if he successfully removes the indicated game object from the lower jaw portion, and, at the end of a round, when the lower jaw portion snaps closed, the player with the largest number of points is determined the winner.

Other objects, features and advantages of the invention will be apparent from the following detailed description taken in connection with the accompanying drawings.

DESCRIPTION OF THE PREFERRED EMBODIMENT

Figures 1, 2, 3, 4:
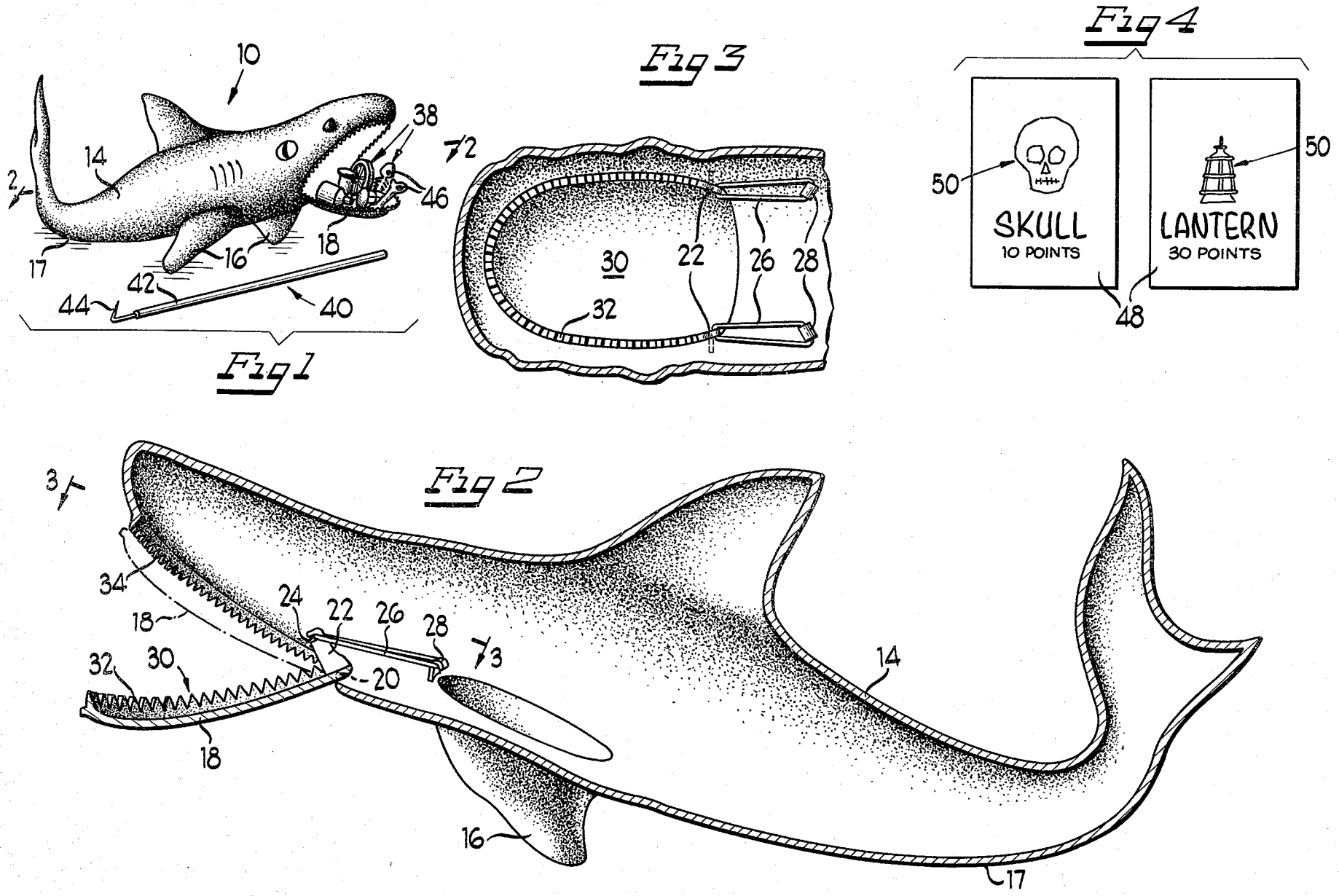
FIG. 1 is a perspective view of the game apparatus of the present invention.
FIG. 2 is a vertical section, on an enlarged scale, taken generally along line 2—2 of FIG. 1.
FIG. 3 is an obtuse section of a portion of FIG. 2 taken generally along line 3—3 thereof.
FIG. 4 is a view of two of the set of playing cards identifying various game objects point awards.

In FIG. 1, the game apparatus of the present invention, generally designated 10, is shown to include a generally hollow housing 14 which is formed in the shape of a toy or miniature shark or other fish or mammal. The shark 14 includes a pair of lower fins 16 which form a tripod with a lower tail portion 17 to support the shark in a generally upright orientation with respect to a supporting surface, such as a table top.

Referring to FIGS. 2 and 3, the shark 14 includes a pivotally mounted lower jaw portion 18 which is mounted at its rearwardmost end by a pair of horizontal pivot pins 20 to the main housing portion 14 of the shark. The lower jaw portion 18 includes a pair of upstanding arms 22 above the pivot pins 20. The arms 22 each including a notch 24 in which resilient means in the form of a rubberband 26 is connected to a pair of hooks 28 formed internally on the housing. The resilient means 26 permit the lower jaw portion 18 to be moved to an open position as shown in FIGS. 1 and 2, but constantly urges the lower jaw portion 18 to its closed position as shown in phantom in FIG. 2. A cavity or receptacle area, generally designated 30, is provided on top of the lower jaw portion 18 by a plurality of saw-tooth shaped teeth 32 which engage or mate with a complementary set of teeth 34 formed on the underside of the front of the housing 14.

A plurality of game objects 38 are provided for placing in the receptacle area 30 to maintain the lower jaw portion 18 in an open position due to the cumulative weight of all of the game objects 38 against the biasing force of the resilient means (rubberbands 26).

During the play of the game, the players attempt to remove the game objects, one at a time, from the lower jaw portion by using a hooked implement in the form of a spear, generally designated 40. The spear 40 includes a relatively long handle portion 42 which is provided with a hook portion 44 on one end thereof. The spear 40 is manually manipulatable by the players of the game in an attempt to lift the game objects 38 out of the "mouth" of the shark. Several of the game objects are provided with a hole or handle 46 to facilitate retrieval usage of the spear 40.

FIG. 4 shows two cards 48 from a set of playing cards which are used during the play of the game. Each player is dealt or picks a card and the indicia 50 printed on the card instructs the player as to which game object 38 he is to attempt to retrieve from the shark's mouth. Additional indicia on the cards 48 defines a particular value or score for a successful retrieval of the associated item from the mouth of the shark 14. As the game objects are successively removed from the lower jaw portion 18, the cumulative weight of the game objects 38 remaining in the shark's jaw will continuously decrease until, at one point, the lower jaw portion 18 will snap shut. The closing of the lower jaw portion defines the end of a round of play and the player with the largest score or accumulated points at that time is declared the winner of the game. Note that the particular relationship between the mechanical advantage provided by the pivotal mounting and the arms 22 preferably allow the bands 26 to quickly snap the lower jaw portion 18 to a closed position after a sufficient number of game objects have been removed.

As shown by the cards 48 and game objects 38, the objects are designed to resemble items possibly recoverable from the oceans, such as lanterns, parts of ships, a skull, etc.

The foregoing detailed description has been given for clearness of understanding only and no unnecessary limitations should be understood therefrom as some modifications will be obvious to those skilled in the art.

I claim:

1. A game apparatus, comprising:

a housing;

a plurality of manually manipulatable game objects, each of said game objects having a predetermined weight and at least some of said objects being a different weight than some of the other of said objects;

a weight actuatable game object receiving receptacle pivotally mounted on the housing, said receptacle being movable between a first open position where the weight of a plurality of game objects placed thereon maintain the receptacle in said first position so that said objects are retrievable by the players of the game and a second closed position where the weight of a lesser number of game objects is not sufficient to maintain the receptacle in said first position so that the remaining game objects are not accessible to the players of the game; and biasing means associated with said receptacle for moving the receptacle from the first position to the second position after the cumulative weight of the game objects has been reduced by selective removal of at least some of said game objects by the players of the game.

2. The game apparatus of claim 1 including a set of playing cards carrying indicating means associating each card with one of the game objects to be selectively chosen by the players of the game to determine which one of said game objects the player shall attempt to retrieve from said receptacle.

3. The game apparatus of claim 1 wherein said biasing means comprises resilient means connected between the housing and the receptacle to bias the receptacle toward said second position.

4. The game apparatus of claim 3 wherein said housing is in the shape of a simulated shark and said object receptacle comprises a lower, movable jaw portion of said shark.

5. The game apparatus of claim 1 including a manually manipulatable implement for use by players of the game in an attempt to retrieve a game object from the receptacle, said implement including on one end thereof means for grasping one of said game objects.

6. The game apparatus of claim 5 wherein said implement comprises an elongated manually manipulatable hook device.

7. A game apparatus, comprising:

a housing in the shape of a simulated shark having a weight actuatable lower jaw portion of the mouth thereof defining a game object receiving receptacle on the housing, said jaw portion being movable between a first open position and a second closed position;

a plurality of manually manipulatable game objects of predetermined weight positionable on the lower jaw portion so that the cumulative weight of a plurality of said game objects maintains the jaw portion in said first position so as to be selectively retrievable therefrom by players of the game when the jaw portion is in said first open position; and biasing means associated with said jaw portion for moving said jaw portion from said first open position to said second closed position after at least some of said plurality of game objects have been selectively retrieved therefrom by the players of the game.

8. The game apparatus of claim 7 wherein said biasing means comprising resilient means connected between the shark housing and the lower jaw portion bias the lower jaw portion toward said second position, and said lower jaw portion is pivotally mounted to said housing so that a predetermined cumulative weight of the game objects can provide sufficient weight to maintain the lower jaw portion in its open position against the force of the resilient means and a lesser cumulative weight will permit the resilient means to move said lower jaw to said closed position.

9. The game apparatus of claim 7 including a set of playing cards carrying indicating means associating each card with one of the game objects to be selectively chosen by the players of the game to determine which one of said game objects the player shall attempt to retrieve from said receptacle.

10. The game apparatus of claim 7 including a manually manipulatable implement for use by players of the game in an attempt to retrieve a game object from the receptacle.

11. A game apparatus, comprising:

a housing in the shape of a simulated shark having a lower jaw portion of the mouth thereof defining a game object receiving receptacle on the housing, said jaw portion being movable between a first open position and a second closed position;

a plurality of manually manipulatable game objects positionable on the lower jaw portion and retrievable therefrom by the players of the game when the jaw portion is in said first position;

biasing means associated with said jaw portion for moving the same from said first open position to said second closed position after at least some of said game objects have been selectively retrieved therefrom by the players of the game; and a manually manipulatable hook device for use by the players of the game in an attempt to retrieve the game objects from the receptacle.

* * * * *